United States Patent [19]

Paurat et al.

[11] Patent Number: 4,645,266

[45] Date of Patent: Feb. 24, 1987

[54] TUNNEL AND GALLERY EXCAVATOR

[76] Inventors: Friedrich W. Paurat, Kasselweg 29, 4230 Wesel 1; Roland Paurat, Blumenstrasse 11, 4230 Wesel 13, both of Fed. Rep. of Germany

[21] Appl. No.: 692,039

[22] Filed: Jan. 16, 1985

[30] Foreign Application Priority Data

Jan. 21, 1984 [DE] Fed. Rep. of Germany ..... 3402031
Jan. 21, 1984 [DE] Fed. Rep. of Germany ..... 3402032

[51] Int. Cl.[4] ..... E21C 35/20; E21C 25/06

[52] U.S. Cl. ..... 299/64; 299/75; 299/18

[58] Field of Search ..... 299/64, 68, 75, 76, 299/78, 73, 18

[56] References Cited

U.S. PATENT DOCUMENTS 2,798,711 7/1957 Silver ..... 299/78
2,920,879 1/1960 Driehaus ..... 299/73
3,052,455 9/1962 McLaughlin et al. ..... 299/76
4,076,316 2/1978 Le Begue ..... 299/64
4,390,211 6/1983 Thompson ..... 299/64

FOREIGN PATENT DOCUMENTS 2113305 8/1983 United Kingdom ..... 299/64

OTHER PUBLICATIONS

"The Way Things Work", 1971, pp. 188–191, George Allen and Unwin Ltd.

*Primary Examiner*—Stephen J. Novosad
*Assistant Examiner*—Michael A. Goodwin
*Attorney, Agent, or Firm*—Karl F. Ross; Herbert Dubno

[57] ABSTRACT

A tunnel and gallery excavator comprises a ground contacting mechanism projecting from the front of a motorized drive and chassis and feeds debris to a conveyor. The digging arm has a pair of extendable supports attached to a yoke connected to the arm. The extendable supports are attached to and supported by the ground-contacting mechanism via pivots affording two degrees of freedom and an operating and adjusting device is provided for the extendable supports.

18 Claims, 8 Drawing Figures

TUNNEL AND GALLERY EXCAVATOR

CROSS REFERENCE TO RELATED APPLICATIONS

Attention is directed to copending applications Ser. No. 586,866 filed Mar. 9, 1984 now U.S. Pat. No. 4,557,373 issued Dec. 10, 1985, and Ser. No. 539,830 filed Oct. 7, 1983 (now abandoned) and to U.S. Pat. Nos. 4,470,635, 4,451,089, 4,470,636, 4,278,293, 4,247,997, 4,173,836, 4,231,618, 4,080,000, 4,095,845, 3,998,493, and 3,729,056.

FIELD OF THE INVENTION

Our present invention relates to an excavator for gallery and tunnel building.

BACKGROUND OF THE INVENTION

A tunneling machine can comprise a motorized drive and chassis for locomotion, particularly a caterpillar or track drive, an excavating or digging arm mounted pivotally on a swivel base and rotatable about a vertically directed swivel base axis passing through the swivel base, and a digging tool attached to the digging arm.

The digging arm can be lowered and raised by pivoting it about a substantially horizontal axis and, if necessary, is also rotatable about a digging or excavating arm axis passing lengthwise through the digging arm.

A ground-contacting mechanism can project from the front side of the motorized drive and behind this a conveyor can be provided for carrying the crushed stone and earth to the rear of the machine.

This apparatus commonly has a ground-contacting mechanism attached to the chassis and drive and which acts as a loading apron or mechanism which feeds the earth and stone debris to a conveyor and thereby removes the debris from the digging location.

In the known earth movers of this type the digging arm is cantilevered from the drive and chassis and has a length approximately equal to the cantilevered or forwardly projecting portion.

In excavation the digging arm can be moved with two degrees of freedom horizontally and vertically. The excavation is, however, accomplished chiefly by vertical motion of the digging arm from above to below or from below to above (or by a motion which has suitable displacement components in the vertical direction).

The employed force or at least the vertical component thereof is herein called the pressing force. This force will produce by way of a particular arrangement a reaction upon the digging arm up and down around the horizontal axis. The reaction force and the reaction moment must be absorbed by the motorized drive and chassis, which is either supported externally at the digging site or must be made up by the weight of the apparatus which must then be provided of a suitable heavy weight. The conventional belief is that the ratio of the apparatus weight to the pressing force should be at least about 5:1, if the apparatus is not to be braced externally.

Objects of the Invention

The principal object of the invention is to provide an improved tunnel and gallery excavator free from drawbacks of prior art machines.

Another object is to provide a tunnel and gallery excavator in which a comparatively larger pressing force can be used without a corresponding increase in the apparatus weight and without external bracing, thereby making the work correspondingly easier.

It is yet another object of our invention to provide an improved apparatus for tunnel and gallery excavation which can be operated with a much larger pressing force for a given total apparatus weight without bracing or otherwise supporting the apparatus externally.

It is a further object of this invention to provide a tunnel and gallery excavator which provides a greater efficiency of operation and is capable of an increased work load by being able to operate with an increased pressing force for a given total weight.

Summary of the Invention

These objects and others which will become more apparent hereinafter are attained in accordance with the invention in an excavator for gallery and tunnel building comprising a motorized drive and chassis, particularly a caterpillar or tracked drive, a digging or excavating arm mounted pivotally on a swivel base so as to be rotatable about a vertical swivel base axis passing through the swival base, and a digging tool (e.g. a toothed or pick-carrying drum) attached to the end of the digging arm not attached to the swivel base.

The excavating arm is lowerable and raisable by rotation about a horizontally directed axis substantially parallel to the ground and rotatable also, in a preferred embodiment, about a digging arm axis passing lengthwise through the digging arm from the swivel base to the digging tool. A ground-contacting mechanism projects from the front side of the motorized drive and chassis and a conveyor for stone and earth debris can be attached behind the front ground contacting mechanism.

According to the invention the excavating arm has at least one extendable support or jack, which has one end pivotally supported on the ground-contacting mechanism, and another end pivotally attached to the digging arm.

The extendable support is attached to the digging arm and/or the ground-contacting mechanism by a universally pivotable mount, for example a Cardan linkage or a ball-and-socket linkage so that the digging arm can be rotated about the swivel base axis or, if desired, about the digging arm axis so as to be slanted.

In the apparatus of the invention additional structures are not required to support or brace the motorized drive and chassis during operation.

The invention uses the fact that in this apparatus the ground-contacting mechanism can fulfill an additional function, namely that it can be a support for one or more of the extendable supports of this invention so that the pressing force can be generated or transmitted by these extendable supports, when the digging arm is guided in an essentially vertical digging motion from below to above.

The total weight of this apparatus need no longer be as large as in the prior art digging apparatuses. The ratio of the pressing force and the weight can then be 1.5:1 to 1:1. This invention also provides an improvement of this pressing force for the digging motion from above to below, because a favorable lever arm exists for the force action.

In a preferred embodiment of this invention two extendable supports are employed and can engage a yoke to which the arm is connected. Furthermore at least one of the extendable supports is preferably oriented essentially vertically. It is understood that the ground-contacting mechanism can be swung up from and set free of the ground during the operation of the apparatus by the extendable support.

Another preferred embodiment of this invention, which is characterized by a particular ease and reliability of operation particularly suited for both galleries and tunnels and having a high work capacity without difficulty, comprises the crosstie bar or yoke attached to the digging arm, and provided with brackets for attachment and support of the extendable supports, each bracket supporting a single extendable support.

The ground-contacting mechanism can be equipped with guide rails, which allow during lateral pivoting of the digging arm the base of the extendable support or the extendable support to be guided so that the extendable support remains nearly vertical during operation.

According to the preferred embodiment the ground-contacting mechanism acts as a loading mechanism for the conveyor which removes stone and earth debris from the vicinity of the digging tool. The ground-contacting mechanism thus fulfills a variety of functions in the invention and may be thought of as a loading apron or loading rim as well as a supporting element.

The digging head can be constructed as a partly divided or multi-cutter apparatus. The excavating head can be constructed as it usually is in a partly divided or multi-cutter apparatus. Particularly it can have a mushroom shaped digging tool, wherein the mushroom axis is coincident with the digging arm axis. Also the digging arm can have several such digging tools or several digging arms.

In the apparatus of the invention the entire width of the roadway or tunnel way being worked can be reached without an excessively large swing of the digging arm.

The excavating arm can have a digging tool which comprises a central, front digging drum symmetrically bisected by the digging tool axis and two lateral digging drums projecting up from the front sides of the digging tool adjacent the central digging drum.

These lateral digging drums act as conveyor screws for the central digging roller and they assist in feeding worked stone and earth debris into the conveyor for removal from the digging area.

A considerably higher pressing force can be used in this apparatus for the excavation of subterranean galleries and tunnels without increasing the weight of the apparatus or external bracing.

Additionally an easily employable mechanism, that is the locally front protruding ground-contacting mechanism, is used to fulfill a double purpose, firstly as a support for the extendable supports and secondly as a loading apron for feeding dirt and rock debris to the apparatus conveyor.

Large pieces of stone or excavated detritus can be easily guided to the machine and broken up. For this purpose the apparatus has a loading mechanism with at least one conveyor screw, which extends at least substantially parallel to or more precisely generally along the digging drums or the front of the apparatus, which works together with the digging drums when the digging arm is lowered to the ground, as an opposing drum for breaking up the rock and earth debris.

According to the preferred embodiment the position of the lowered digging arm is adjustable so as to be able to handle earth and rock debris of different size.

Also for this purpose the rotation direction speed and the applied power of the digging rollers can be adjusted. The invention utilizes the fact that a dynamic force or a static supporting force on the digging arm and the digging tool can be converted by the extendable supports into a force for breaking up the rock and earth debris formed between the digging drums and the conveyor screw. Thus the ground-contacting mechanism can additionally function as a roller breaker.

BRIEF DESCRIPTION OF THE DRAWING

The objects, features and advantages of our invention will become more readily apparent from the following description, reference being made to the accompanying diagrammatic drawing in which.

SPECIFIC DESCRIPTION

Figure 1:
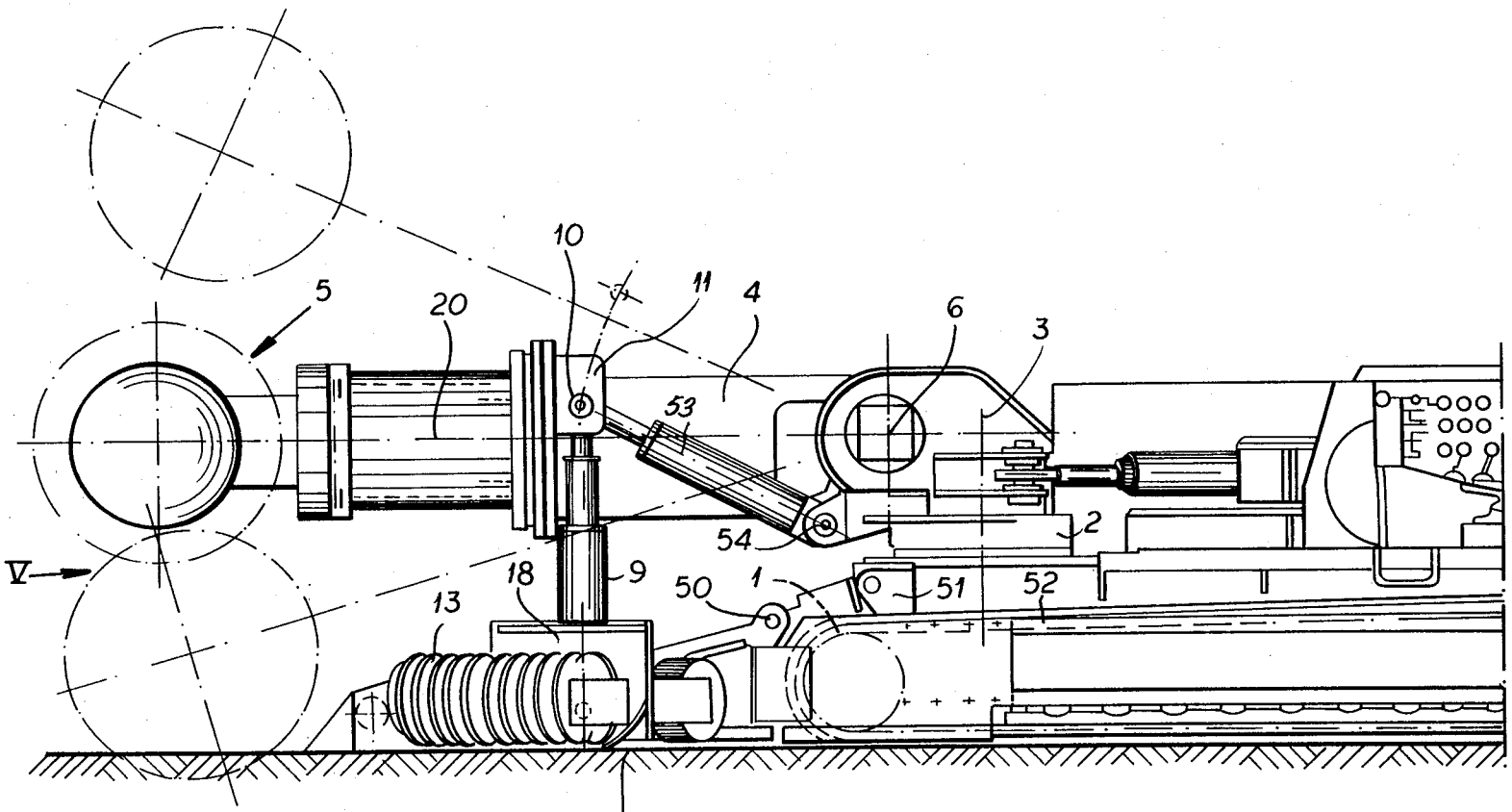
FIG. 1 is a side elevational view of an excavator for subterranean tunnel and gallery building according to this invention.

The excavator shown in the drawing comprises a motorized drive and chassis 1, which is preferably a caterpillar or tracked drive chassis as shown in the drawing, a swivel base or turntable 2, rotatable about a vertical axis 3, a digging arm 4 swingable around the vertical swivel base axis 3 on the turntable 2, and a digging or excavating tool 5.

Swivel base 2 can be any of a variety of different structures by which conventional dredging arms, excavating arms and derrick arms are pivotally mounted. It is apparent that the earth mover apparatus is equipped with a suitable operating mechanism and control apparatus for the digging arms, the digging tool and the motorized drive.

The digging arm 4 is also swingable up and down about a horizontal axis 6. It is also rotatable about the digging arm axis 20 indicated by the dot-dash line in the drawing.

A ground-contacting mechanism 7 is attached pivotally to the drive and chassis 1 immediately in front of the drive 1. This ground-contacting mechanism 7 functions as a loading apron for transporting rock and earth debris formed by digging to a flight conveyor 8 for moving this debris from the digging site rearwardly centrally below the machine.

The digging arm 4 has further preferably two extendable supports or jacks 9, which can be telescoping pneumatic or hydraulic cylinders, i.e. fluid-operated attached thereto.

The extendable supports 9 are supported on the ground-contacting mechanism 7. The extendable supports 9 are moreover connected at their upper ends to the excavating arm 4 by a pivotable mount 10, for example, a Cardan or a ball-and-socket joint (see FIG. 4A).

Consequently extendable supports 9 can be oriented slantedly by a swing of the digging arm 4 around the swivel axis 3 and, if required, around the digging arm axis 20.

The extendable supports 9 serve therefore to raise or lower the digging arm 4 vertically as well as to support it in position, and the extendable supports 9 are correspondingly not braced by other components on the drive and chassis 1 directly, but directly act on the ground by way of the ground-contacting mechanism 7.

Advantageously the extendable supports 9 are attached to ground-contacting mechanism 7 by pivotable mounts 10' riding in guide rails 18 which extend in the direction of travel.

The extendable supports 9 are any of a variety of types of hydraulic cylinders or fluid driven piston-cylinder arrangements and are provided with an operating and control means for extending retracting or holding them in place.

On the digging arm 4 a horizontal crosstie bar or yoke 11 is attached, this yoke 11 having two brackets 12 projecting down from the digging arm 4 located on opposing sides of the crosstie bar or yoke 11.

In the preferred embodiment these brackets 12 are located at the ends of the crosstie bar 11 and are of the same size. One extendable support 9 is attached to one bracket 12.

As already mentioned, the ground-contacting mechanism 7 is constructed as in part a loading apron for the conveyor 8 for the excavated earth or stone. In the specific embodiment shown two load screws or conveyor screws 13 are attached to run slantingly on opposite front sides of the ground-contacting mechanism 7.

Figure 2:
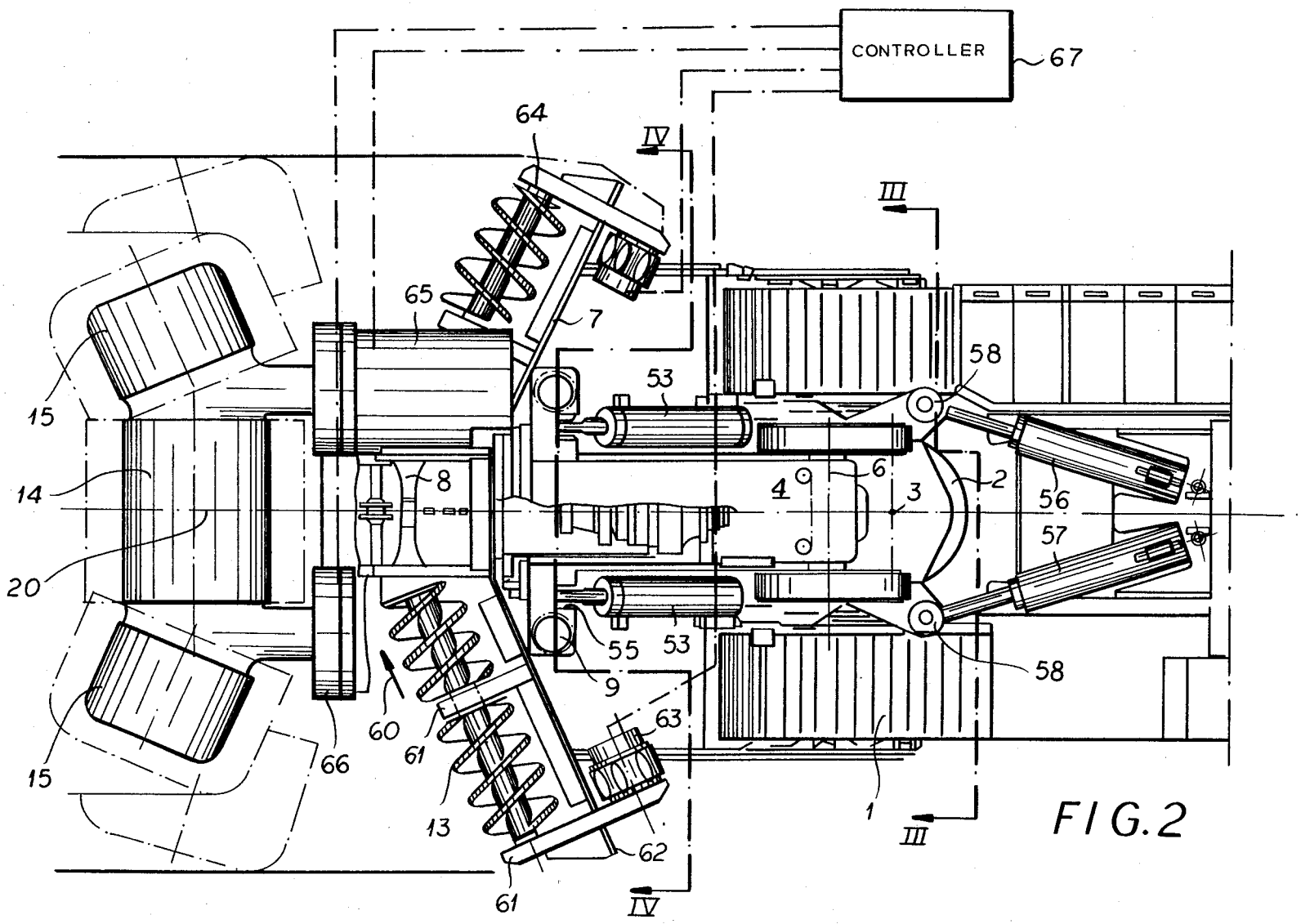
FIG. 2 is a partial top view of the excavator of FIG. 1.
Figure 3:
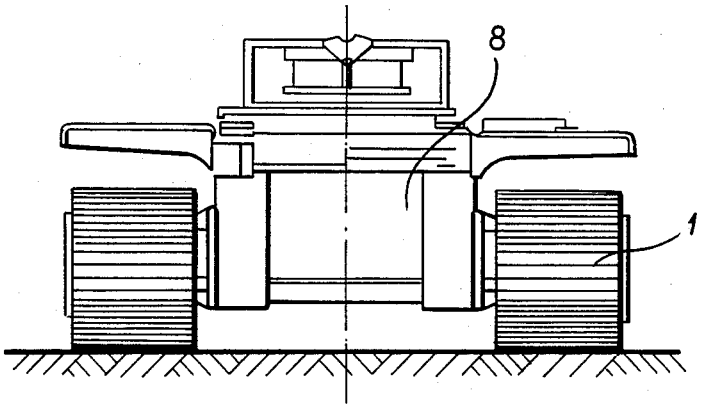
FIG. 3 is a vertical cross sectional view of the excavator taken along the line III—III of FIG. 2.
Figure 5:
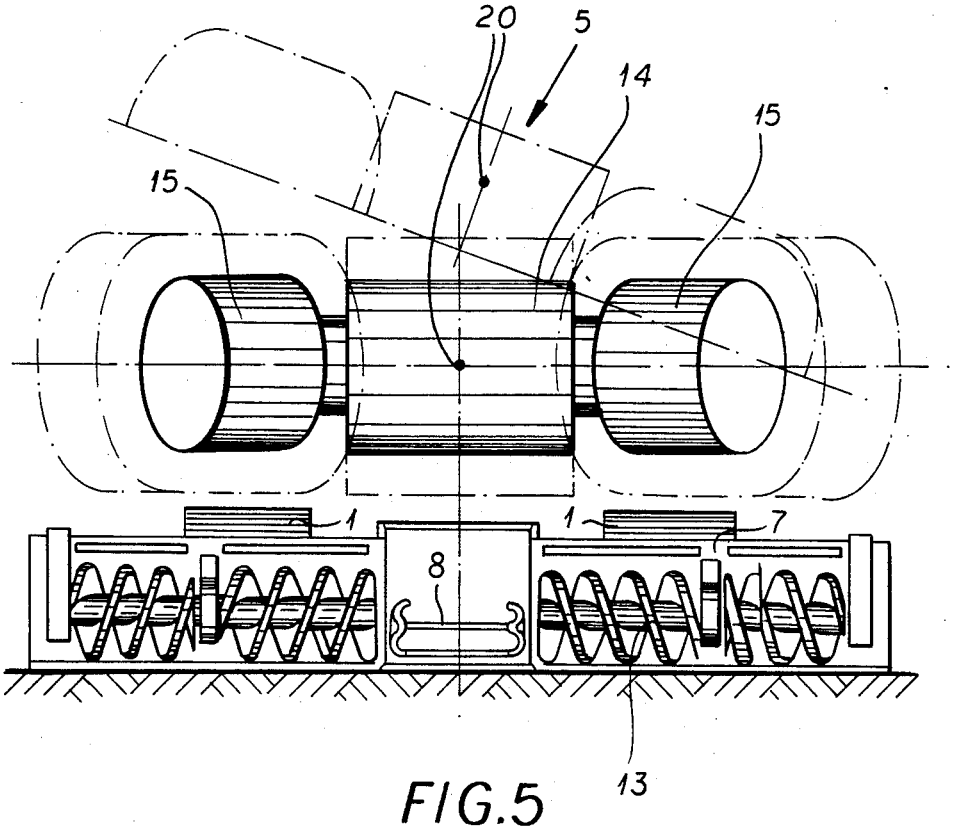
FIG. 5 is a view of the apparatus in the direction shown by the arrow V in FIG. 1.

As is especially clearly shown in FIGS. 2 and 5, the digging arm 4 has a digging tool 5 which comprises a central front projecting digging drum 14 symmetrically bisected by the digging arm axis 20 and two lateral digging drums 15 attached on opposing front sides of the digging arm 4 adjacent to digging drum 14. The lateral digging drums 15 are sometimes constructed as lateral helical screw conveyors.

The excavating picks and teeth have been represented by dot-dash outlines of their path in FIGS. 1 and 2. In this arrangement the earth and stone face is first contacted by the digging drum 14 and assisted by the lateral digging drums 15, the excavated earth and stone debris is transported to the conveyor 8 by the ground-contacting mechanism 7 acting as a loading apron. The digging drums can be driven in either rotation direction.

From a comparison of FIGS. 1 and 2 it can be seen that the loading mechanism has a conveyor screw 13, which extends generally parallel to the front digging drum 14 or to the digging drum 15 or at least can lie in a plane parallel thereto.

Figure 6:
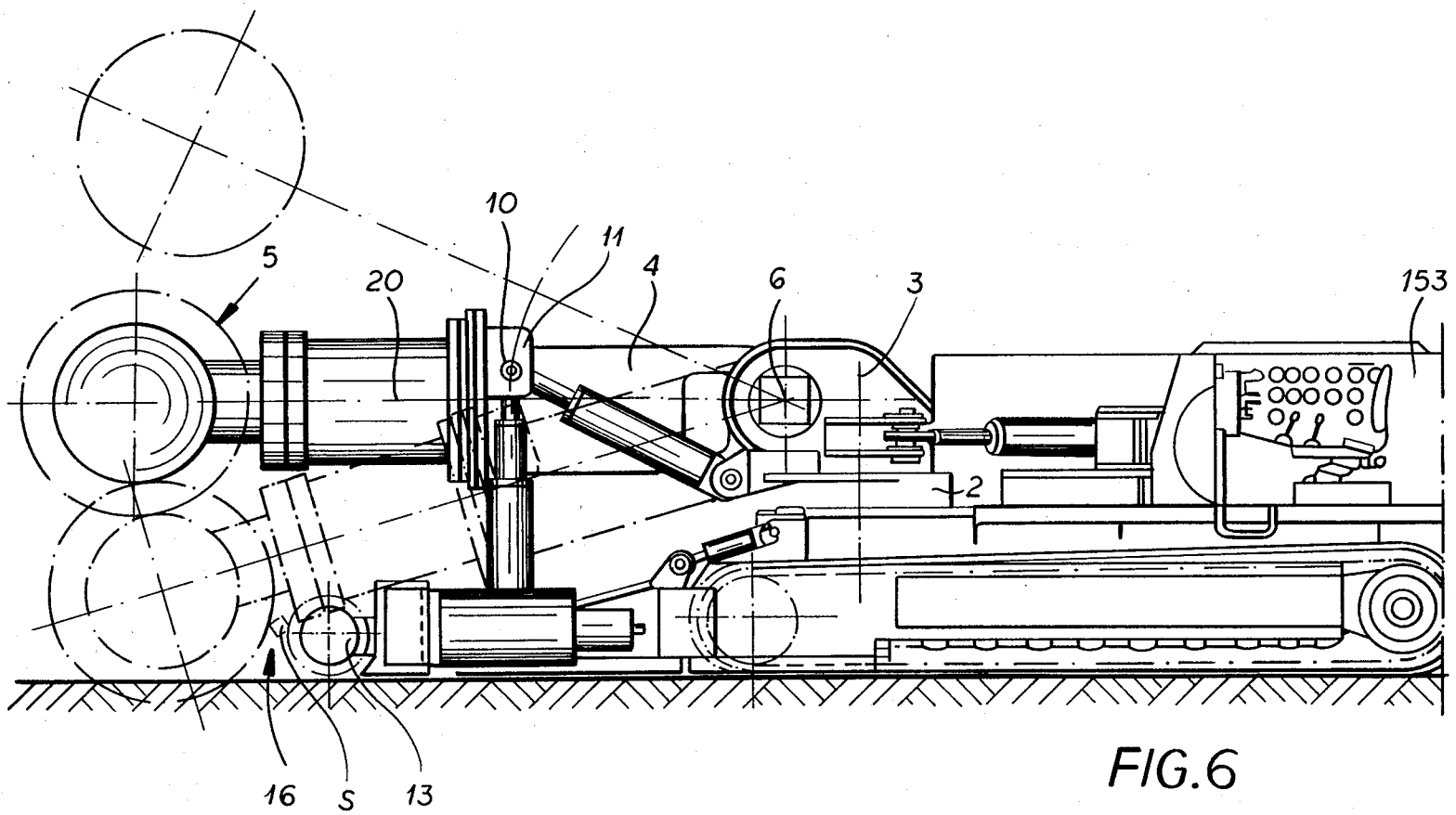
FIG. 6 is a partial side elevational view illustrating the operation of a modified apparatus of FIG. 1.
Figure 7:
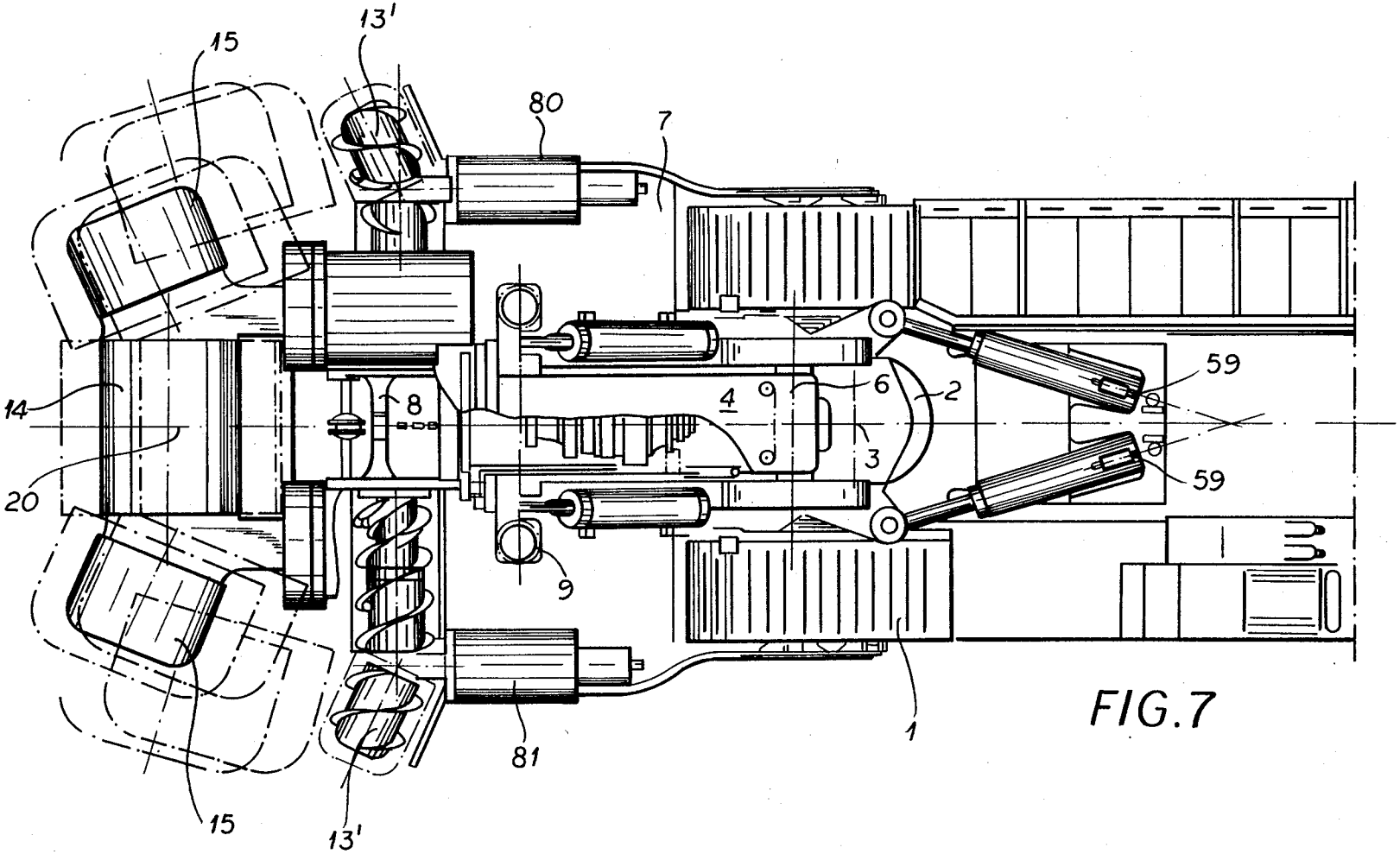
FIG. 7 is a diagrammatic top view illustrating the operation of the apparatus of FIG. 6.

The conveyor screw 13 is constructed to act as a rolling crusher as well as a debris transport device and, of course, in such a way that this rolling crusher 13 works together with the digging drums 14 and 15 with a suitably lowered digging arm 4 as a counterdrum for pulverizing rock or stone formed by the breaking or cracking process. In FIGS. 6 and 7 this configuration is indicated by bold heavy dot-dash lines. Additionally one infers from FIG. 6 that the rock and stone digging position 16 can be varied adjustably for different size rock and stone debris. The maximum size of the crushed rock and stone debris is indicated in the FIG. 6 by S which corresponds to the greatest spacing of the coacting drums in the crushing mode.

It is of course understood the drive power, the rotation speed and the rotation direction of the conveyor screws 13, the digging roller 14 and the digging rollers 15 are all adjustable during the digging operation.

While the general principles of the invention have been outlined above, it should be apparent that the ground-contacting mechanism 7, against which the double-acting telescoping cylinders 9 can be braced to support these cylinders on the floor of the gallery or tunnel is pivotally mounted at articulations 50 upon the chassis 51 which carries the tracks 52 and a drive engine for these tracks in a compartment 153 (FIG. 6).

In the embodiment of FIGS. 1–5, moreover, the ground-engaging mechanism 7 can be raised and lowered when the yoke 11 is elevated and the telescoping cylinder arrangements 9 are retracted. The yoke and hence the arm 4 can be raised and lowered by cylinders which are pivotally connected by swivel joints 54 and 55 to the chassis and yoke, respectively, may be provided.

The turntable 2 carrying the arm 4 may also be swung about the axis 3 by a pair of oppositely effective double-acting cylinders 56 and 57 which are connected by articulations 58 to the turntable and by articulations not shown in detail but located at 59 to the chassis.

As can be seen from FIG. 2, moreover, the worms 13 which convey the detritus inwardly in the direction of arrow 60 toward the conveyor 8, are journaled on supports 61 of the ground-engaging mechanism which has a trough 62 guiding the detritus inwardly. The worms are rotated by a motor 63 on each side of the ground-engaging mechanism connected by transmissions of the chain or gear type in housings 64 of the ground-engaging mechanism.

The motors, e.g. hydraulic motors, for driving the excavating drums 14 and 15 are represented at 65 and 66 and the controller for regulating the driving energy for the excavating drums 14, 15, the direction of rotation thereof and the speed of the worms 13 has been represented at 67 in FIG. 2 and is connected to the motors 65, 66 and 63 by dot-dash lines in FIG. 2.

Figure 4A:
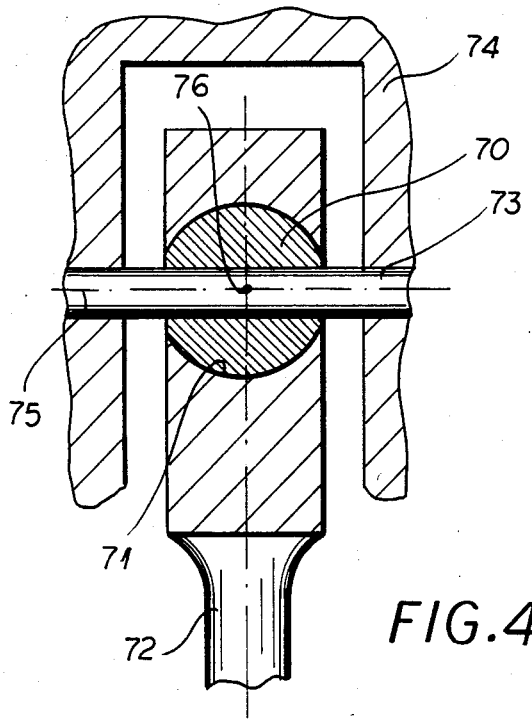
FIG. 4A is a detail section of a swivel joint used in the apparatus.
Figure 4:
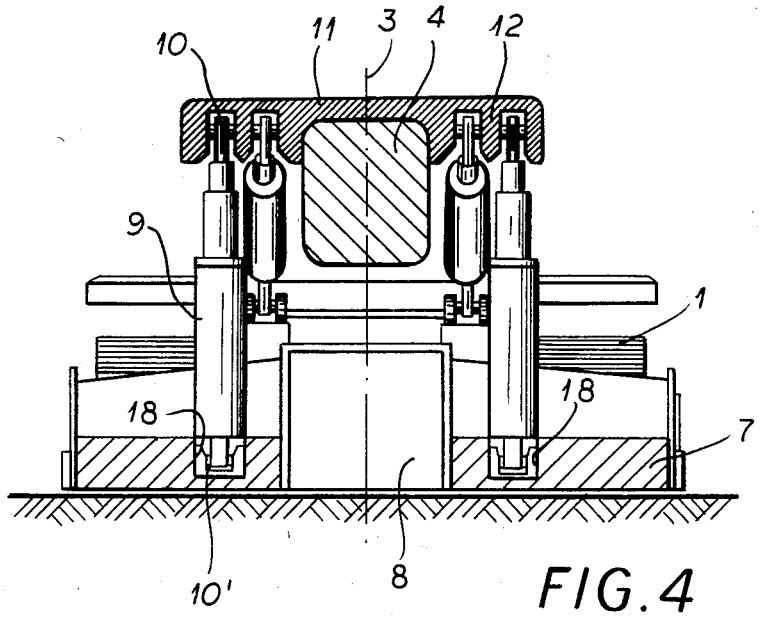
FIG. 4 is a vertical cross sectional view of the apparatus taken along the line IV—IV of FIG. 2.

In FIG. 4A, we have shown swivel articulations such as have been used at 10, 10', 55 and 54. Each of these articulations can include a ball 70 received in a socket 71 formed in a piston rod 72 or an extension of the cylinder. The ball 70 is traversed by a pin 73 lodged in the chassis, yoke or a bracket or mount movable in the tracks and represented at 74.

The socket 71 can thus rotate relative to the ball with two degrees of freedom, i.e. about axis 75 defined by the rod 73 and about an axis 76 perpendicular thereto and to the plane of the paper in FIG. 4A.

In the embodiment shown in FIG. 7, while structurally similar to that of FIGS. 1 and 2, it can be seen that the worms 13' are here provided with segments which are parallel to the excavating drums 14 and 15, respectively, and which are driven by the motors 80 and 81 which can be connected to a controller in the manner described in connection with FIGS. 1 and 2. The gap S formed when the excavating drums are lowered to function as a detritus or debris breaker, therefore, is a gap between mutually parallel excavating drum sections and conveyor worm sections.

We claim:

1. In a tunnel and gallery excavator comprising a motorized drive and chassis, a digging arm mounted pivotally on a swivel base on said chassis so as to be rotatable about a vertically directed swivel base axis, a digging tool attached to an end of said digging arm, said digging arm being lowerable and raisable by pivoting about a horizontal axis, a ground-contacting mechanism projecting from the front of said motorized drive and chassis, and a conveyor for stone and earth debris attached behind said front ground-contacting mechanism, the improvement wherein said digging arm has at least one extendable support attached thereto, said extendable support being supported by and connected to said ground-contacting mechanism, and an operating and adjusting means is provided for raising and lowering said extendable support, said digging arm being elongated and having a longitudinal digging arm axis, said digging tool comprising a front protruding central digging drum symmetrically bisected by said digging arm axis and two lateral digging drums attached to opposite front sides of said digging arm adjacent said front digging drum, said ground-contacting mechanism being formed so as to collect debris and having at least one conveyor screw attached at its front which is oriented substantially parallel to a portion of said tool, said conveyor forming with said portion a breaking-up tool which is juxtaposed with said lowered digging arm to crush and pulverize said debris and also to transport said debris to said conveyor.

2. The improvement defined in claim 1 wherein each of said extendable supports is attached to said digging arm by a pivotable mount having at least two degrees of freedom.

3. The improvement defined in claim 2 wherein said pivotable mount is a Cardan joint.

4. The improvement defined in claim 2 wherein said pivotable mount is a ball-and-socket joint.

5. The improvement defined in claim 1 wherein a pair of such extendable supports are provided and each of said extendable supports is attached to said ground contacting mechanism and supported thereon by a pivotable mount.

6. The improvement defined in claim 5 wherein each of said pivotable mounts is Cardan joint.

7. The improvement defined in claim 5 wherein each of said pivotable mounts is a ball-and-socket joint.

8. The improvement defined in claim 5 wherein each of said extendable supports is attached to said digging arm by a pivotable mount.

9. The improvement defined in claim 8 wherein each pivotable mount is a Cardan joint.

10. The improvement defined in claim 8 wherein each of said pivotable mounts is a ball-and-socket joint.

11. The improvement defined in claim 8 wherein said excavator is provided with a yoke attached to said digging arm and a respective pivotable mount for each of said extendable supports is attached to a bracket at opposite ends of said yoke.

12. The improvement defined in claim 1 wherein each of said extendable supports is substantially vertically oriented.

13. The improvement defined in claim 1 wherein said ground-contacting mechanism is formed as a loading apron which guides stone and earth debris formed in the digging operation into said conveyor.

14. The improvement defined in claim 1 wherein rock and earth debris of various sizes can be more effectively processed by adjusting the position of said lowered digging arm, said excavator having means for adjusting the distance between said conveyor screw and said portion.

15. The improvement defined in claim 1 wherein the operating power, the rotation direction and the rotation speed of said digging tool are adjustable.

16. The improvement defined in claim 1 wherein said ground-contacting mechanism is equipped with at least one guide rail which guides each of said extendable supports during pivotal motion of said digging arm.

17. A mine gallery and tunnel excavator which comrpises:

a tracked chassis movable along a gallery upon the excavation of a face thereof ahead of said chassis;

a turntable mounted on said chassis and rotatable about a vertical axis thereon;

an excavating arm having a free end and swingably mounted on said turntable about a horizontal axis for raising and lowering the free end of said arm about said horizontal axis;

means braced between said chassis and said arm for rasing and lowering said arm about said horizontal axis;

a yoke on said free end of said arm extending transversely to a longitudinal axis of said arm, said arm extending generally forwardly from said chassis;

a gallery-face cutting head mounted on said yoke and engageable with a face of said gallery for excavating said face to advance said gallery, thereby forming debris, a reaction force being developed on said cutting head upon its engagement with said face;

a floor-engaging mechanism pivotally mounted on said chassis at a front end thereof and provided with conveying means for displacing said debris onto a conveyor for removing said debris from ahead of said chassis; and a pair of substantially upright fluid-operated cylinders braced between said mechanism and said yoke on opposite sides of said longitudinal aixs and pivotally connected to at least one of said yoke and said mechanism for applying an upward force to said cutting head, counteracting the reaction force thereon, said mechanism including at least one worm conveyor parallel to at least a portion of said cutting head, said conveying means in a lowered position of said arm defining a breaking gap with said head, said gap being adjustable by the displacement of said head by said upright cylinders.

18. The excavator defined in claim 17 wherein said yoke and said head are angularly displaceable about said longitudinal axis and said cylinders are connected to at least one of said yoke and mechanism by swivels allowing two degrees of freedom of pivotal displacement, said head comprising a main cutting drum having an axis lying substantially perpendicular to said longitudinal axis and a pair of lateral cutting drums having axes of rotation inclined to said axis of said main cutting drum.

* * * * *